United States Patent [19]

Josephy

[11] 4,116,359

[45] Sep. 26, 1978

[54] THROUGH HOLE DEFORMATION AND INSIDE SEALING TEAR STRIP

[75] Inventor: Karl Josephy, Los Angeles, Calif.

[73] Assignee: The Continental Group, Inc., New York, N.Y.

[21] Appl. No.: 844,183

[22] Filed: Oct. 21, 1977

[51] Int. Cl.[2] ..... B65D 41/02; B65D 41/32

[52] U.S. Cl. ..... 220/265; 220/270; 220/389; 113/121 C; 29/509

[58] Field of Search ..... 220/265, 260, 269, 270, 220/359; 29/509, 522; 113/121 C; 53/41, 42, 43

[56] References Cited

U.S. PATENT DOCUMENTS

| | | | |
|---|---|---|---|
| 3,579,809 | 5/1971 | Wolf | 29/509 OR |
| 3,990,603 | 11/1976 | Brochman | 220/260 OR |
| 4,034,132 | 7/1977 | Manuel | 220/265 X |

*Primary Examiner*—George T. Hall
*Attorney, Agent, or Firm*—Charles E. Brown

[57] ABSTRACT

An easy opening container member having an opening therethrough which may be utilized for dispensing a product. The inner surface of the container member is provided with a protective coating which may be damaged in the forming of the opening. A laminated tear strip is bonded to the exterior of the body member and has a localized portion extruded through the opening with the tear strip having an inner plastics material layer which is reversely folded and is bonded to the coating to mask any damaged areas thereof. The reverse folding of the plastics material layer may be accomplished in the manner of heading a rivet or the plastics material layer may have a part thereof stripped from the adjacent layer and separately folded and bonded to the protective coating.

12 Claims, 7 Drawing Figures

THROUGH HOLE DEFORMATION AND INSIDE SEALING TEAR STRIP

This invention relates in general to new and useful improvements in easy opening containers, and more particularly to an easy opening container wherein a dispensing opening is initially formed in the container member and is then sealed by a removable tear strip.

Container members in the recent past have been provided with one or more openings for the purpose of dispensing a product therein and these openings have been closed by a removable tear strip. Such tear strips are generally of a laminated metal-plastics material construction and are removable from a position overlying the opening for the purpose of permitting the product to be dispensed from the container. In most instances at least the inner surface of the container member is provided with a protective layer or coating. Such protective coating is normally formed of a plastics material and, while it has good adherence to the surface of the container member, it is most economically applied to the container member or the sheet metal from which it is formed prior to the forming of the opening or openings in the container member. When the opening or openings in the container member are later formed, there is a chipping and nicking of the protective coating so that the protective coating does not properly mask the inner surface of the container member immediately surrounding the opening. As a result, coating repair is necessary, and such a coating repair operation can be expensive.

In accordance with this invention it is proposed to extrude a localized portion of the tear strip through the opening and thereafter radially outwardly fold at least the plastics material layer into contact with the protective coating surrounding the opening and bonding the plastics material to the protective coating both for the purpose of sealing the opening and masking the protective coating.

In the simplest form of the invention, the extruded portion of the tear strip is so formed that it may be headed in the manner of a conventional rivet thereby radially outwardly folding the entire thickness of the tear strip to underlie the container member surrounding the opening and thus form the necessary seal and mask.

In a preferred embodiment of the invention, the laminated tear strip is locally extruded thorugh the opening and then while held in position projecting through the opening, a die engages the tear strip and strips the plastics material layer from the adjacent layer and reversely folds the plastics material layer radially outwardly around the opening so as to mask the protective coating immediately surrounding the opening.

In accordance with this invention, when the plastics material and the material of the protective coating are ones which may be heat bonded together, the tool or die utilized for effecting the stripping of the plastics material layer and the folding thereof may be heated and serve to provide sufficient heat to effect the necessary bonding of the stripped plastics material to the protective coating.

It has also been found beneficial to form the laminate of the tear strip to include an aluminum second layer, which aluminum layer is exposed during the stripping of the plastics material layer and remains exposed to form a sacrificial aode.

With the above and other objects in view that will hereinafter appear, the nature of the invention will be more clearly understood by reference to the following detailed description, the appended clams, and the several views illustrated in the accompanying drawings.

IN THE DRAWINGS

Figure 1:
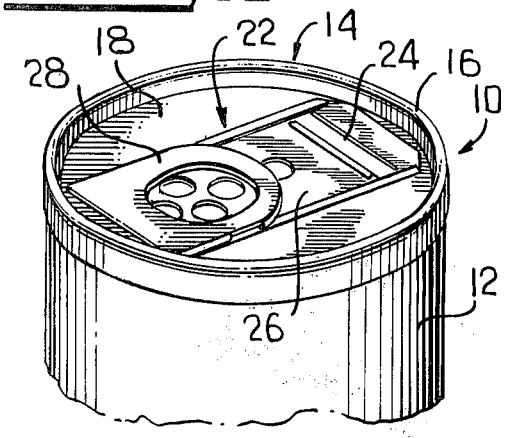
FIG. 1 is a fragmentary top perspective view of an easy opening container formed in accordance with this invention.

Referring now to FIG. 1 in particular, it will be seen that there is illustrated an easy opening container generally identified by the numeral 10. The container 10 is basically a known type of container in the form of a can which includes a body 12 having one end thereof closed by an end unit generally identified by the numeral 14. The end unit is sealed to the body 12 by means of a conventional double seam 16 and has an end panel 18 which is provided with a plurality of apertures or openings, one such opening being illustrated in FIG. 2 and identified by the numeral 20. It is to be understood that when there are a plurality of openings 20, they will be so disposed as to provide a preselected dispensing pattern.

The opening or openings 20 are closed by a removable tear strip, generally identified by the numeral 22. In the preferred embodiment, the tear strip 22 includes an end portion 24 which is permanently bonded to the outer surface of the end panel 18 so that the tear strip 22 may remain permanently attached to the end unit 14 even after the conainer 10 has been opened.

The tear strip 22 also includes a main body portion 26 which overlies the opening or openings 20 and is sufficiently sealed to the end panel 18 to prevent leakage of the container 10 while being peelable from the end panel 18. The tear strip 22 also includes a grip portion 28 which is reversely folded into overlying relation with respect to the body portion 26.

It is to be understood that the end unit 14 is formed of sheet metal which in order to protect the packaged product in some instances and in other instances to protect the sheet metal, is provided with an inner protective coating 30. While this protective coating may be of different materials, it is preferably a plastics material. Further, the protective coating 30 is normally applied to the sheet metal of the end unit while the sheet metal is in flat form and prior to the forming of the end unit 14 therefrom. In the forming of the opening or openings 20, the protective coating 30 immediately surrounding the opening or openings 20 is chipped or otherwise damaged so as not properly to protect the end panel 18 surrounding the opening or openings 20. In accordance with this invention, it is proposed to so modify the tear strip 22 as to function as a mask for the damaged protective coating 30.

It is also pointed out here that the external surface of the end unit 14 may have thereon a protective coating 32. The protective coating 32 may be of such material so as to be directly bondable to the tear strip 22. With respect thereto, it is pointed out that the tear strip 22 is preferably formed from a laminate which includes an outer aluminum layer 34 and an inner protective material layer 36 which may be either directly bonded to one another or by way of an intermediate adhesive layer 38. The plastics material of the layer 36 may beneficially be formed of polypropylene which is readily heat bondable to many known plastics materials suitable for forming the protective coatings 30, 32. On the other hand, a separate adhesive may be utilized to bond the plastics material layer 36 to the external surface of the end panel 18. A special adhesive (not shown) may be used to bond the terminal end portion 24 of the tear strip to the end panel so as to prevent the removal of the tear strip.

Figure 2:
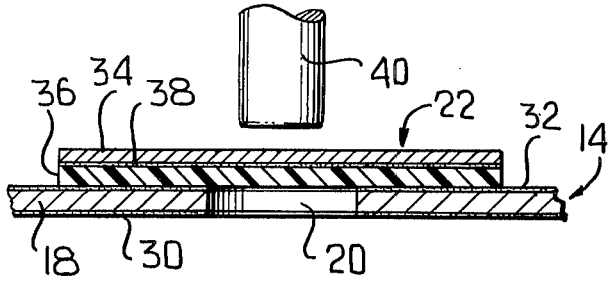
FIG. 2 is an enlarged schematic view showing a tear strip bonded to an exterior surface of a container member preparatory to a localized portion thereof being extruded through the underlying opening.
Figure 4:
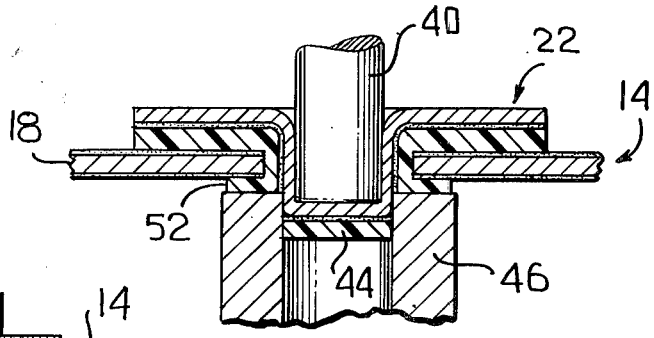
FIG. 4 is a sectional view similar to FIG. 2 and shows the die having stripped the plastics material layer from the inwardly extruded portion of the tear strip and folding the same into sealing engagement with the protective coating.
Figure 3:
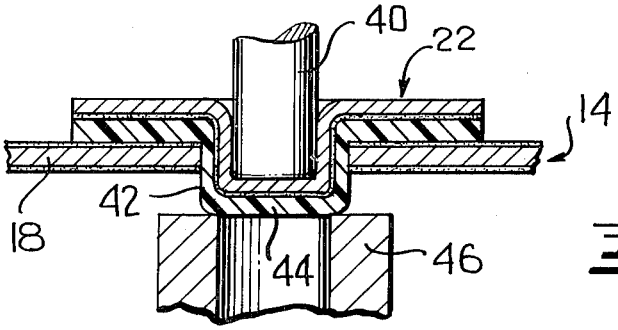
FIG. 3 is a sectional view similar to FIG. 2 and shown the localized portion of the tear strip extruded through the opening by means of a punch and there being positioned relative to the punch an extruded tear strip portion and a stripping and folding die.
Figure 5:
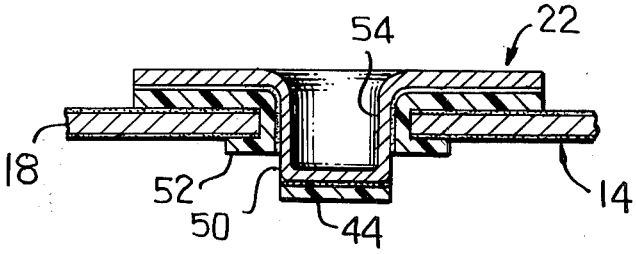
FIG. 5 is an enlarged fragmentary sectional view taken through one of the openings in the container member with the opening being sealed in accordance with the method steps of FIGS. 2–4.

Reference is now made to FIGS. 2–4 as to a preferred method of utilizing the material of the tear strip 22 to mask the damaged protective coating 30. A punch 40 extends down through each opening 20 extruding the portion of the tear strip 22 aligned with the opening 20 through the opening 20 in the manner shown in FIG. 3. After this initial extruding step, the tear strip 22 is provided in each opening 20 with a cylindrical portion 42 terminating in an integral end wall 44. At this time the laminated construction of the tear strip 22 remains intact.

While the end unit 14 and the punch 40 are suitably maintained in place, a tubular die 46 is moved axially relatively to the punch 40. It is to be seen that the die 46 has a circular opening 48 of a diameter corresponding to the external diameter of the layer 34 in the cylindrical portion 42. Accordingly, when the die 46 is moved upwardly relative to the end unit 14 and the punch 40, it will strip from the cylindrical portion 42 the plastics material layer 36 and fold the same radially outwardly into underlying relation with respect to the end panel 18 surrounding each opening 20. This stripping operation will leave the end wall 44 intact in its laminated condition. At the same time, it will expose that part of the cylindrical portion 42 of the metal layer 34 as at 50. It will be seen that the folded stripped portion of the plastics material layer is identified by the numeral 52.

It is preferred that the die 46 be heated so that as it strips and folds the plastics material layer 36, it will also heat it sufficiently to effect the bonding of the folded material 52 to the protective coating 30.

The net result of the entire operation is that each opening 20 has part of the tear strip 22 forced down there-through to function as a plug 54 while at the same time the opening is sealed by the stripped plastics material 52. In addition, the damaged protective coating 30 surrounding the opening 20 is masked by the stripped plastics material 52. In addition, the exposed portion 50 of the layer 34, where desired, and when the layer 34 is formed of a suitable metal, may function as a sacrificial anode.

It is also considered feasible in accordance with this invention to provide an adhesive for bonding the stripped plastics material to the protective coating 30 if this is found to be necessary. It is also to be understood that while reference has been made with respect to a single punch 40 and a single die 46 for operating on the tear strip 22 with respect to a single opening 20, when there are plural openings 20 there will be a multiple punch and multiple die arrangement.

Figure 6:
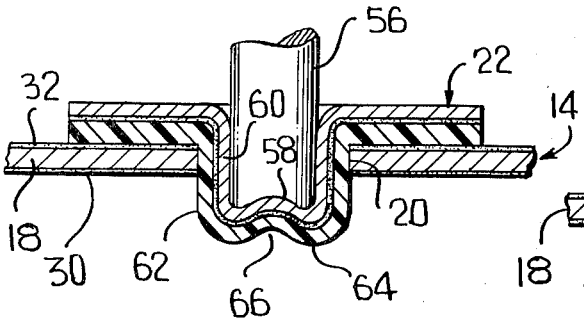
FIG. 6 is a sectional view similar to FIG. 3 and shows a modified extruding operation.
Figure 7:
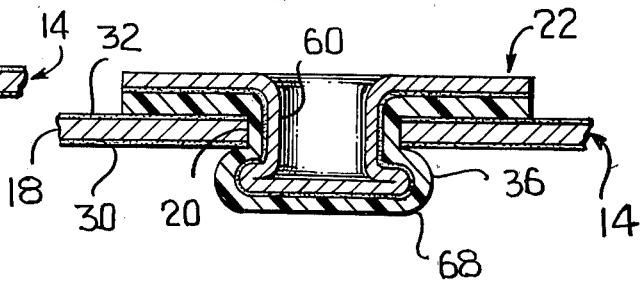
FIG. 7 is a sectional view similar to FIG. 5 through a modified opening sealing arrangement.

Reference is now made to FIG. 6 wherein a modified form of the invention is illustrated. In lieu of extruding the tear strip 22 and stripping the plastics material layer in the manner illustrated in FIGS. 2–5, the portion of the tear strip 22 aligned with each opening 20 may be extruded through that opening by means of a punch 56 which is preferably provided with a recess 58 in the end thereof. As a result, the punch 56 will extrude through the opening 20 a plug 60 which includes a cylindrical portion 62 and an end wall 64 having a centrally located outwardly directed bubble 66 in accordance with the recess 58. After the plug 60 has been so formed, utilizing conventional riveting punch and anvil tooling, the plug 60 may be upset to define a head 68 of the rivet type as shown in FIG. 7. The head 68 will be of sufficient radial extent so as to underlie the end panel 18 surrounding the opening 20 with the plastics material layer 36 of the tear strip being in pressure contact with the protective coating 30 and serving to mask the damaged areas thereof immediately surrounding the opening 20.

If deemed necessary the plastics material layer 36 of the head 68 may be heat bonded or selectively adhesively bonded to the protective coating 30.

Although only a single opening 20 has been illustrated and described in the embodiment of FIGS. 6 and 7, it is to be understood that there may be plural openings in the manner described with respect to the container 10 in FIG. 1.

Although only two embodiments of the easy opening container have been specifically illustrated and described herein, it is to be understood that minor variations may be made in the easy opening container without departing from the spirit and scope of the invention as defined by the appended claims.

What is claimed as new is:

1. A method of closing an opening in a container member and at the same time masking defects in a coating on the container member adjacent the opening, said method comprising the steps of providing a container body having an opening therethrough and a protective coating on at least an inner surface thereof, applying a laminated tear strip of the type having a plastics material underlayer to an outer surface of the container member, extruding a localized portion of the tear strip through the opening, and then reversely turning at least the plastics material layer of the tear strip radially outwardly of the opening into sealing engagement with the protective coating on the container member.

2. The method of claim 1 wherein the plastics material is bonded to the coating.

3. The method of claim 1 wherein the container member and the coating thereon are heated, and the plastics material is heat bonded to the coating.

4. The method of claim 1 wherein said reversely turning is effected by stripping a part of the plastics material layer of said localized portion from an adjacent layer of said tear strip and reversely folding the stripped plastic part against said container body surrounding the opening.

5. The method of claim 4 wherein said stripping is effected while the extruded portion is held within the opening.

6. The method of claim 4 wherein said stripping is effected while the extruded portion is held within the opening, and said stripping and reversely folding is part of a continuous operation.

7. The method of claim 4 wherein the tear strip includes an aluminum layer, and the aluminum layer is exposed when the plastic layer is stripped therefrom to form a sacrificial anode.

8. The method of claim 1 wherein the extruded portion is formed with an outwardly disposed central bubble and is thereafter outwardly and radially deformed.

9. An easy opening container unit comprising a container member having an inner surface and an opening therethrough, said container member having a protective coating on the inner surface thereof, a laminated tear strip temporarily closing said opening, said tear strip including an inner layer of plastics material, said tear strip being releasably bonded to the exterior of said container member with a portion of said tear strip being extruded through said opening, and at least the plastics layer being folded radially outwardly around said opening and bonded to said protective coating to seal said opening and mask any defects which may exist in said protective coating surrounding said opening.

10. The container unit of claim 9 wherein said extruded portion has a rivet-like head.

11. The container unit of claim 9 wherein said inner layer has a portion thereof stripped from the remainder of said tear strip, and only said stripped portion is folded radially outwardly.

12. The container unit of claim 11 wherein said tear strip includes a metal layer which is exposed in the stripping of said plastic layer, and said exposed metal layer portion forms a sacrificial anode.

* * * * *